US007051896B2

(12) United States Patent
Steadman

(10) Patent No.: US 7,051,896 B2
(45) Date of Patent: May 30, 2006

(54) OPENING ASSEMBLY

(76) Inventor: William David Steadman, 7858 Meadow Lark Lane, Port Saint Lucie, FL (US) 34592

( * ) Notice: Subject to any disclaimer, the term of this patent is extended or adjusted under 35 U.S.C. 154(b) by 14 days.

(21) Appl. No.: 10/467,255

(22) PCT Filed: Jan. 23, 2002

(86) PCT No.: PCT/GB02/00274

§ 371 (c)(1),
(2), (4) Date: Aug. 5, 2003

(87) PCT Pub. No.: WO02/064437

PCT Pub. Date: Aug. 22, 2002

(65) Prior Publication Data

US 2004/0065664 A1 Apr. 8, 2004

(30) Foreign Application Priority Data

Feb. 12, 2001 (GB) ..... 0103404.0

(51) Int. Cl.
*B65D 41/06* (2006.01)
*B65D 41/36* (2006.01)
*B65D 17/34* (2006.01)

(52) U.S. Cl. ..... 220/294; 220/304; 220/906; 220/254.8; 220/270

(58) Field of Classification Search ..... 220/211, 220/233, 250, 254.7, 254.8, 266, 270, 281, 220/286, 288, 293, 294, 301, 302, 787, 789, 220/791, 793, 800, 805, DIG. 19, DIG. 33, 220/304, 906, 269; 215/295, 296, 298, 305, 215/211, 250; 222/153, 521
See application file for complete search history.

(56) References Cited

U.S. PATENT DOCUMENTS

| | | | | |
|---|---|---|---|---|
| 631,907 | A * | 8/1899 | Schmalenbach | 220/210 |
| 2,733,052 | A * | 1/1956 | Luther | 366/205 |
| 2,749,618 | A * | 6/1956 | Landon | 33/414 |
| 2,974,824 | A * | 3/1961 | Etsuo | 220/271 |
| 3,262,612 | A * | 7/1966 | Tabor | 222/484 |
| 3,289,881 | A * | 12/1966 | Ganung | 220/254.1 |
| 3,331,638 | A * | 7/1967 | Fruth | 301/108.2 |
| 3,473,692 | A * | 10/1969 | Moller | 220/265 |

(Continued)

FOREIGN PATENT DOCUMENTS

FR 2651749 A * 3/1991

(Continued)

*Primary Examiner*—Nathan J. Newhouse
*Assistant Examiner*—James Smalley
(74) *Attorney, Agent, or Firm*—Wattts Hoffmann Co., LPA

(57) ABSTRACT

A opening assembly (10) suitable for use on a can for containing carbonated beverages. The assembly (10) comprises a main part (14) with an oval opening (16). A flange (18) is provided around the underside of the opening (16), with a height inversely proportional to the diameter of the opening (16) at any point. A closure member (20) is provided comprising an upper part (14), cylindrical body part (30) which sliding fits through the opening (16), and an engagement member (34) on its underside. In a closed condition the engagement member (34) engages against the tallest part of the flange (18) to sealingly close the assembly (10). The closure member (20) can be rotated until the engagement member (34) is not engageable with the flange (18), and the member (20) can then be removed from the opening (16) to open the assembly (10). The member (20) can be replaced in the opening (16) and rotated to reclose the assembly (10).

41 Claims, 2 Drawing Sheets

U.S. PATENT DOCUMENTS

| | | | | | |
|---|---|---|---|---|---|
| 3,659,738 | A | * | 5/1972 | Friedmann et al. | 220/287 |
| 3,672,547 | A | * | 6/1972 | Kozlowski | 222/567 |
| 3,704,804 | A | | 12/1972 | Kaercher et al. | |
| 3,784,047 | A | * | 1/1974 | Cooper | 220/301 |
| 3,843,011 | A | | 10/1974 | Perry | |
| 3,877,604 | A | * | 4/1975 | Brown | 220/267 |
| 3,945,529 | A | * | 3/1976 | Haag | 220/254.1 |
| 3,952,911 | A | * | 4/1976 | Bozek et al. | 220/269 |
| 4,043,474 | A | * | 8/1977 | McCord | 215/211 |
| 4,171,057 | A | * | 10/1979 | Gach | 215/211 |
| 4,179,038 | A | * | 12/1979 | Rosan, Jr. | 220/243 |
| 4,224,017 | A | * | 9/1980 | Kayne | 431/291 |
| 4,516,683 | A | * | 5/1985 | Delia | 215/211 |
| 4,605,141 | A | | 8/1986 | Won | |
| 4,640,435 | A | | 2/1987 | Dutt | |
| 4,747,511 | A | * | 5/1988 | Dutt et al. | 220/254.2 |
| 4,915,252 | A | * | 4/1990 | Schaffer | 220/791 |
| 5,080,249 | A | | 1/1992 | Shock | |
| 5,443,175 | A | * | 8/1995 | Kelly et al. | 220/298 |
| 6,106,757 | A | * | 8/2000 | Ohlsson et al. | 264/251 |

FOREIGN PATENT DOCUMENTS

| | | | | |
|---|---|---|---|---|
| GB | 638258 | | | 6/1950 |
| GB | 2234426 | A | * | 2/1991 |
| GB | 2 254 070 | A | | 9/1992 |
| WO | WO 01/05663 | A2 | | 1/2001 |

* cited by examiner

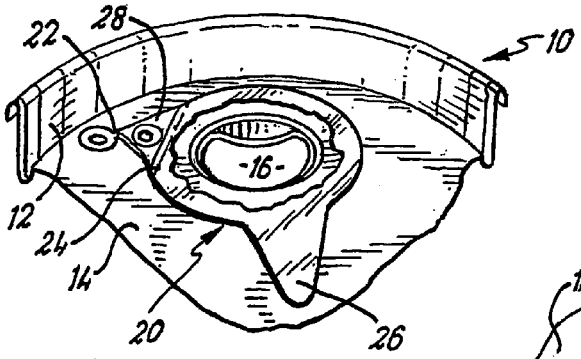
FIG. 1
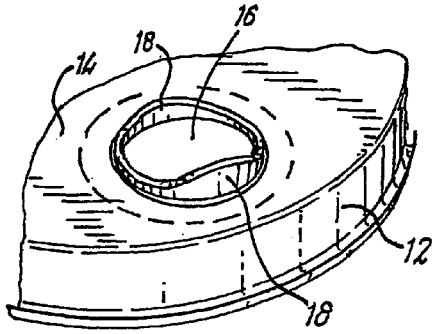
FIG. 3
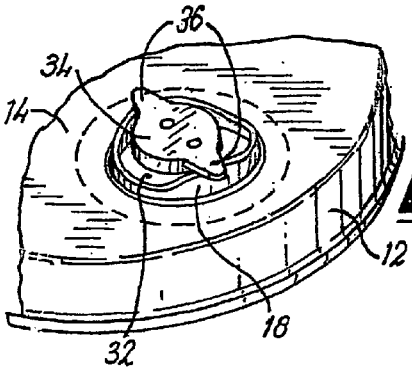
FIG. 2
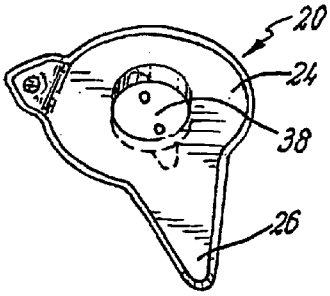
FIG. 4
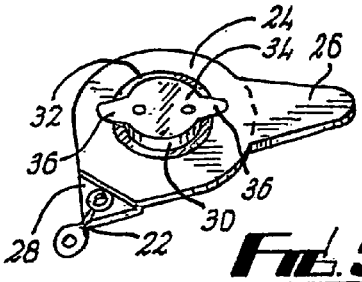
FIG. 5
FIG. 6
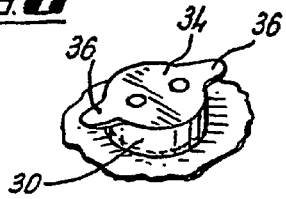
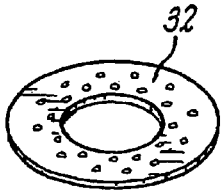
FIG. 7

OPENING ASSEMBLY

This invention concerns improvements in or relating to opening assemblies for beverages containers, and particularly but not exclusively opening assemblies for containers usable with carbonated beverages; and also beverage containers including such an opening arrangement.

One type of container conventionally used for carbonated beverages is a can with a ring pull arrangement. Whilst these have proved very popular, a number of disadvantages can be encountered with them. For instance, it is not possible to dose the can once opened, and the contents therefore have to be consumed at one time. This can be a particular problem with children or when travelling, in that a container could for instance be knocked over and therefore the contents spilt. Also there is a potential hygiene problem as the top of the cans can become dirty, and this part can come into contact with some of the can's contents and/or a person drinking from the can.

According to the present invention there is provided an opening assembly for a beverage container which container is sealed after filling, the assembly comprising a main part which closes the container and in which is provided a port, and a closure member, the assembly being arranged such that in an initial condition following filling the closure member sealingly locates in the port to dose same and hence dose the container, the closure member can be removed from the port to open the container, and following opening, in a first orientation, the closure member can be relocated in the opening, and upon rotation of the closure member to a second orientation the closure member substantially sealingly recloses the opening and hence the container.

The port preferably has a greater diameter in a first direction and a lesser diameter in a second direction substantially perpendicular thereto. The port may be substantially oval.

The closure member preferably comprises an engagement part with a greatest diameter in a longitudinal direction The closure member is preferably configured such that it can only be introduced into, or removed from, the port when the longitudinal direction of the engagement part is at least generally parallel to the first direction of the port. The assembly is preferably configured such that when the closure member is located in the port in the first orientation, and then rotated to the second orientation, the engagement part engages the underside of the main part adjacent the port around the second direction.

A flange is preferably provided around the port on the underside of the main part, against which flange the engagement part is engagable. The flange is preferably tallest at the part of the port adjacent the second direction, and the height of the flange may be substantially inversely proportional to the diameter of the port at any point.

The closure member may comprise an upper part which is always in normal use located outside of the container, and a body part extending therefrom which provides at or adjacent its free end the engagement part.

The body part is preferably slidably locatable substantially in the centre of the port.

The engagement part may comprise diametrically opposite projections on the body part, spaced from the upper part.

The upper part may be larger than the port so as to wholly cover the port when the closure member closes same. A handle part, which may comprise a projecting finger, is preferably provided on the upper part to facilitate rotation thereof.

A sealing member may be provided on the underside of the upper part and engageable against the main part around the opening. made of neoprene, and which may be in the form of a washer located around the body part.

A breakable seal may be provided extending between the closure member and the main part to provide a visual indication when a container has been opened. The breakable seal is preferably arranged such that it must be broken to permit the closure member to move from the second orientation to the first orientation.

A link member may be provided extending between the closure member and the main part to prevent loss of the closure member.

A depression may be provided in the upper surface of the main part to facilitate rotation of the closure member.

The invention also provides an opening assembly for a drinks can, the assembly being according to any of the preceding fourteen paragraphs.

The invention further provides a beverage container including an opening assembly according to any of the preceding fifteen paragraphs.

The container may comprise a can. Alternatively, the container may be made of plastics material.

Embodiments of the present invention will now be described by way of example only and with reference to the accompanying drawings, in which:

FIG. 1 is a diagrammatic partially cut away perspective view from above of part of a first opening assembly according to the invention;

FIG. 2 is a diagrammatic perspective view from below of a similar part of the assembly of FIG. 1 in a closed condition;

FIG. 3 is a similar view to FIG. 2 but in an open condition;

FIGS. 4 and 5 are respectively upper and lower perspective views of part of the assembly of FIG. 1;

FIGS. 6 and 7 are perspective views of further parts of the assembly of FIG. 1.

FIGS. 1 to 7 show a first opening assembly 10 suitable for use on a can for containing carbonated beverages. The assembly 10 forms the top part of a can and will be mounted to an upstanding flange of the can following filling.

Figure 8:
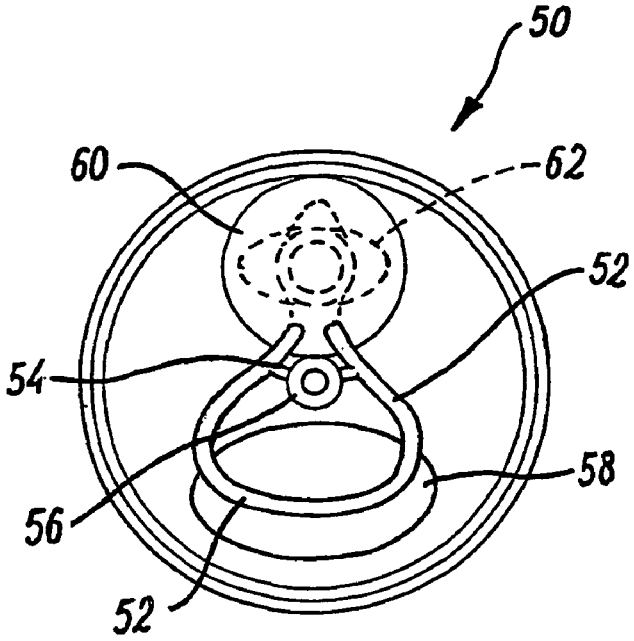
FIGS. 8 and 9 are plan views respectively in a fully closed and partially closed condition of a second opening assembly according to the invention.

The assembly 10 comprises an upstanding flange 12 surrounding a generally planar main part 14. A port in the form of an oval opening 16 is provided in the main part 14, towards one side thereof. A flange 18 is provided around the underside of the opening 16, and the height of the flange 18 is substantially inversely proportional to the diameter of the opening 16 at any point, and hence is at its tallest at the narrow part of the opening 16.

A closure member 20 is provided which in a closed condition is attached to the main part 14 by a breakable seal 22. The closure member 20 comprises an upper part 24 of generally circular configuration with a finger 26 projecting therefrom, and also a smaller tab 28 which mounts the breakable seal 22. On the underside in use of the upper part 24, a body part 30 which is cylindrical is provided. A neoprene washer 32 extends around the body part 30 against the underside of the upper part 24. An engagement member 34 is mounted on the underside of the body part 30 and provides two diametrically opposite radial fingers 36.

The assembly 10 can be formed using conventional techniques, with the opening 16 being formed by pressing, and the flange 18 therearound also being formed by pressing. The body part 30 is formed by pressing out a central part of the upper part 24, and in fact leaves a well 38 in the top of the upper part 24. The engagement member 34 comprises a disc with two diametrically opposite fingers, and is riveted onto the body part 30.

In use, a can or other container is filled and the assembly 10 mounted thereon in a conventional manner. The assembly 10 will be closed as shown in FIG. 1 and this will be evidenced by the breakable seal 22. In a closed position the body part 30 extends into the opening 16 with the fingers 36 engaging against the tallest part of the flange 18. This arrangement urges the main part 14 against the washer 32 which surrounds the opening 16 to provide a seal.

To open the assembly 10 the closure member 20 is rotated in an anti-clockwise direction as shown in FIG. 1. This causes the seal 22 to break, and once the fingers 36 are aligned generally parallel to the longitudinal direction of the opening 16, the closure member 20 can be lifted therefrom. If it is required to reclose the opening 16 the closure member 20 can be placed back therein, with the fingers 36 pointing generally parallel to the longitudinal direction of the opening 16. The closure member 20 can then be rotated in a clockwise direction bringing the fingers 36 against the tallest part of the flange 18 and thereby urging the upper part 24 against the washer 32 and thus against the main part 14 around the opening 16.

There is thus provided an opening assembly of relatively simple and conventional construction but which provides for ready opening and also reclosing of a beverage container as required.

Figure 9:
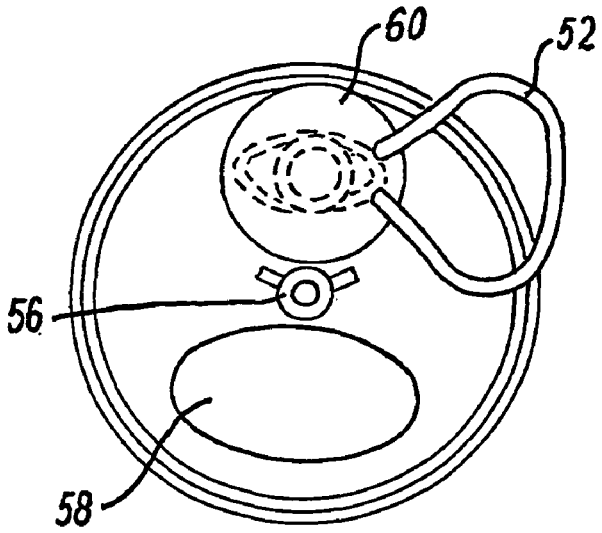

FIGS. 8 and 9 show a second assembly 50 according to the invention which is similar to the first assembly except as follows. Rather than a finger on the upper member a wire loop 52 is provided. A breakable seal 54 is provided between an upstanding part 56 on the main part of the assembly 50 and the wire loop 52. A flexible link (not shown) may be provided between said part and for instance the loop 52 to prevent loss of the closure member 60. A depression 58 is provided in the main part opposite the opening 62 to facilitate rotation of the closure member. The assembly 50 can be used in a similar manner to the assembly 10.

Various modifications may be made without departing from the scope of the invention. For instance, the opening may be a different shape, though the oval shape has been found to be advantageous in that it essentially provides for automatic correct location of the closure member on the opening. The engagement member may be a different shape or take a different form. The closure member may have a different form. Whilst the embodiments described above are described in relation to beverage cans, such assemblies could be used on a wide range of different containers.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. An opening assembly for a beverage container which container is sealed after filling, the assembly comprising a main part which closes the container and in which is provided a port, and a closure member, the assembly being arranged such that in an initial condition the closure member sealingly locates in the port to close same and hence close the container, the closure member can be removed from the port to open the container, characterized in that the port has a greater diameter in a first direction and a lesser diameter in a second direction substantially perpendicular thereto, and following opening, in a first orientation, the closure member can be relocated in the opening, and upon rotation of the closure member to a second orientation the closure member coactingly engages against a substantially continuous undulating flange integral to the main part, which re-closes the opening with a seal effective to retain gasses under pressure and hence the container.

2. An assembly according to claim 1, characterized in that the port is substantially oval.

3. An assembly according to claim 1, characterized in that the closure member comprises an engagement part with a greatest diameter in a longitudinal direction.

4. An assembly according to claim 3, characterized in that the closure member is configured such that it can only be introduced into, or removed from, the port when the longitudinal direction of the engagement part is at least generally parallel to the first direction of the port.

5. An assembly according to claim 4, characterized in that the assembly is configured such that when the closure member is located in the port in the first orientation, and then rotated to the second orientation, the engagement part engages the underside of the main part adjacent the port around the second direction.

6. An assembly according to claim 5, characterized in that a flange is provided around the port on the underside of the main part, against which flange the engagement part is engageable.

7. An assembly according to claim 6, characterized in that the flange is tallest at the part of the port adjacent the second direction.

8. An assembly according to claim 7, characterized in that the height of the flange is substantially inversely proportional to the diameter of the port at any point.

9. An assembly according to claim 1, characterized in that a breakable seal is provided extending between the closure member and the main part to provide a visual indication when a container has been opened.

10. An assembly according to claim 9, characterized in that the breakable seal is arranged such that is must be broken to permit the closure member to move from the second orientation to the first orientation.

11. An assembly according to claim 1, characterized in that a link member is provided extending between the closure member and the main part to prevent loss of the closure member.

12. An assembly according to claim 1, characterized in that a depression is provided in the upper surface of the main part to facilitate rotation of the closure member.

13. An opening assembly for a drinks can, characterized in that the assembly is according to claim 1.

14. A beverage container characterized in that the container includes an opening assembly according to claim 1.

15. A container according to claim 14, characterized in that the container comprises a can.

16. A container according to claim 14, characterized in that the container is made of plastics material.

17. In combination with a beverage container, a closure assembly comprising:

a) a main part surrounded by a flange connected to the container;

b) the main part including a recloseable oblong port through which the container contents may be poured;

c) near the port a substantially continuous undulating flange integral to the main part;

d) a subassembly for closing the port comprising:

i) an upper part for positioning above the main part in an overlying relationship with the port;

ii) a selected one of a finger and a loop extending from the upper part for causing rotation of the subassembly relative to the main part in response to applied pressure;

iii) an engagement member connected to the upper part through a body part in spaced relationship for coaction with the flange for caming the subassembly into a closed position; and, iv) the subassembly being moveable between the closed position and an open position to enable contents of the container to be dispensed through the port characterized in that the body part is slidably locatable substantially in the centre of the port.

18. In combination with a beverage container, a closure assembly comprising;

a) a main part surrounded by a flange connected to the container;

b) the main part including a recloseable oblong port through which the container contents may be poured;

c) near the port a substantially continuous undulating flange integral to the main part;

d) a subassembly for closing the port comprising:

i) an upper part for positioning above the main part in an overlying relationship with the port;

ii) a selected one of a finger and a loop extending from the upper part for causing rotation of the subassembly relative to the main part in response to applied pressure;

iii) an engagement member connected to the upper part through a body part in spaced relationship for coaction with the flange for caming the subassembly into a closed position; and, iv) the subassembly being moveable between the closed position and an open position to enable contents of the container to be dispensed through the port.

19. An assembly according to claim 18, characterized in that the engagement part comprises diametrically opposite projections on the body part, spaced from the upper part.

20. An assembly according to claim 18, characterized in that the upper part is larger than the port so as to wholly cover the port when the closure member closes same.

21. An assembly according to claim 20, characterized in that a sealing member is provided on the underside of the upper part and engageable against the main part around the opening.

22. An assembly according to claim 21, characterized in that the sealing member comprises a resilient member.

23. An assembly according to claim 22, characterized in that the sealing member is made of neoprene.

24. An assembly according to claim 21, characterized in that the sealing member is in the form of a washer located around the body part.

25. An assembly according to claim 18, characterized in that a handle part is provided on the upper part to facilitate rotation thereof.

26. An assembly according to claim 25, characterized in that the handle part comprises a projecting finger.

27. The combination of claim 18 wherein the sub-assembly when in the open position is removable from the remainder of the assembly.

28. The combination of claim 27 wherein the subassembly is returnable to the closed position after it has been removed from the remainder of the assembly.

29. The combination of claim 28 wherein there is a washer between the upper and main parts when the subassembly is in the closed position.

30. The combination of claim 18 wherein there is a washer between the upper and main parts when the subassembly is in the closed position.

31. In combination with a beverage container, a closure assembly comprising;

a) a main part surrounded by a flange connected to the container;

b) the main part including a recloseable oblong port through which the container contents may be poured;

c) near the port a substantially continuous undulating flange integral to the main part;

d) a subassembly for closing the port comprising:

i) an upper part for positioning above the main part in an overlying relationship with the port;

ii) a selected one of a finger and a loop extending from the upper part for causing rotation of the subassembly relative to the main part in response to applied pressure;

iii) an engagement member connected to the upper part through a body part in spaced relationship for coaction with the flange for caming the subassembly into a closed position; and, iv) the subassembly being moveable between the closed position and an open position to enable contents of the container to be dispensed through the port.

32. The combination of claim 31 wherein said flange is an elliptical flange such that the greatest depth of the flange relative to the main part is substantially at a minor axis of the ellipse and the smallest depth of the flange relative to the main part is substantially at a major axis of the ellipse.

33. An opening assembly for a beverage container comprising:

a) an upstanding flange surrounding a planar main part;

b) an oblong orifice in said main part;

c) an inner undulating flange formed from the main part surrounding the perimeter of the orifice; and d) a closure subassembly comprising;

i) a breakable seal attached to the main part;

ii) an upper part comprising a finger and a smaller tab mounted to the breakable seal;

iii) an under part which includes a body part with a washer extending around the circumference of said body part; and iv) an engagement member mounted on the underside said body part and comprises a two diametrically opposed radial fingers for sealingly engaging the inner flange.

34. An opening assembly for the beverage container in claim 33, wherein the height of the inner flange is substantially inversely proportional to the diameter of the opening at any point, and hence is at its tallest at the narrow part of the opening.

35. An opening assembly for the beverage container in claim 33, wherein said orifice is substantially oval.

36. An opening assembly for the beverage container in claim 33, wherein the greatest depth of the inner flange relative to the main part is substantially at a minor axis of an ellipse and the smallest depth of the inner flange relative to the main part is substantially at a major axis of an ellipse.

37. An opening assembly for the beverage container in claim 33, wherein the subassembly, when in the open position, is removable from the remainder of the opening assembly.

38. An opening assembly for the beverage container in claim 33, wherein the subassembly is returnable to the closed position after it has been removed form the remainder of the opening assembly.

39. An opening assembly for the beverage container in claim 33, wherein said finger is provided on the upper part to facilitate rotation thereof.

40. An opening assembly for the beverage container in claim 33, wherein a depression is provided in the upper surface of the main part to facilitate rotation of the closure subassembly.

41. An opening assembly for a beverage container comprising:

a) an upstanding flange surrounding a planar main part;

b) an oblong orifice in said main part:

c) an inner undulating flange formed from the main part surrounding the perimeter of the orifice; and d) a closure subassembly comprising;

i) a breakable seal attached to the main part;

ii) an upper part comprising a finger and a smaller tab mounted to the breakable seal;

iii) an under part which includes a body part with a washer extending around the circumference of said body part; and iv) an engagement member mounted on the underside said body part and comprises a two diametrically opposed radial fingers for sealingly engaging the inner flange.

* * * * *